United States Patent [19]

Carter et al.

[11] 4,077,595

[45] Mar. 7, 1978

[54] CAULKING GUN HOLDER

[76] Inventors: Coleman J. Carter, 1001 Kayak Ave., SE., Hillside; Arden Leonard, 5315 Altoona St., Capital Heights, both of Md. 20027

[21] Appl. No.: 738,974

[22] Filed: Nov. 4, 1976

[51] Int. Cl.[2] ..... E06C 7/14

[52] U.S. Cl. ..... 248/210; 248/300

[58] Field of Search ..... 248/210, 211, 238, 300

[56] References Cited

U.S. PATENT DOCUMENTS

| | | | |
|---|---|---|---|
| 1,865,283 | 6/1932 | Sohnle | 248/210 |
| 2,883,134 | 4/1959 | O'Halloran | 248/210 |
| 2,895,700 | 7/1959 | Johnson | 248/210 |
| 3,052,442 | 9/1962 | Rankin, Jr. | 248/210 |
| 3,227,411 | 1/1966 | Treutler | 248/210 |
| 3,332,653 | 7/1967 | Hoelzel | 248/210 |

*Primary Examiner*—Roy D. Frazier
*Assistant Examiner*—Peter A. Aschenbrenner
*Attorney, Agent, or Firm*—Jerald Jay Zeger

[57] ABSTRACT

This invention relates to a Caulking Gun Holder suitable for an extension ladder or for a step ladder. Different modifications are described of a reversible Caulking Gun Holder that can be mounted on the left or right rail or stile of a ladder.

6 Claims, 20 Drawing Figures

CAULKING GUN HOLDER

This invention relates to a Caulking Gun Ladder attachment, and has for its object to produce a simple inexpensive device of this character by means of which a caulking gun, or its like, may be readily attached to a ladder, one wherein the caulking gun, or its like, may be maintained securely in place, and one which in practice will allow the ease of removing the caulking gun, or its like, when its is desired to use said caulking gun, or its like, while the operator is standing upon a ladder, and more particularly to a simple and efficient device, holder or ladder attachment for receiving and holding a caulking gun when not in use.

It is an object of this invention to provide a simple device, preferably stamped out of one piece of sheet metal, and provided with flexible means for attachment to the rail or stile of a step ladder or an extention ladder for conveniently holding a caulking gun, or its like.

This invention relates to an attachment for a ladder for use by caulkers, glazers, painters, decorators and other tradesmen in supporting caulking guns, and their like, upon a ladder in a convenient manner.

During the use of a caulking gun upon a ladder, it is a safety hazard to lie said caulking gun upon a step or rung of said ladder when not in use as said caulking gun can readily fall from said step or rung and either injury the workers holding up the ladder, or working below; or the cartridge within the caulking gun can be destroyed by the fall of the caulking gun. Therefore, another object of the present invention resides in the provision of a ladder attackment for holding a caulking gun, or its like, which prevents the caulking gun, or its like, from falling from the ladder during work or during moving said ladder, and further, which allows the worker to reposition said ladder without constantly carriying said caulking gun up and down said ladder.

One of the primary objects of this present invention resides in the provision of a ladder attachment, holder or device capable of holding a caulking gun, or its like, when not in use, and which is capable of being easily and securely attached to a ladder at a selected height in a manner so as to embrace one of the rails or stiles of the ladder and overlie one of the steps or rungs thereof while maintaining the holder portion of the ladder attachment disposed at one side or the other side of the ladder so as not to interfere or provide an encumbrance to anyone walking up and down the ladder, and further, so as not to interfere or provide an encumbrance to the use of the extention portion of an extention ladder.

A further object of the invention resides in the provision of a ladder attachment for caulking guns, or their like, capable of being formed or bent out of suitable sheet metal and fabricated from a single blank of metal, thereby producing a very cheap and easily manufactured caulking gun ladder attachment, and which not only enables the ready attachment to a ladder, but when so attached is not easily displaced or moved when said caulking gun, or its like, is removed from or replaced in said caulking gun ladder attachment, but the caulking gun ladder attachment itself can be readly and easily moved to different selected heights at the convenience of the worker.

Still further objects and features of this invention reside in the provision of a ladder attachment for caulking guns, or their like, which lends itself to practical and reliable use on a side rail or stile of either (1) an extention ladder or (2) a step ladder and which can be applied for use on either the lefthand stile or the righthand stile in keeping with the requirements of the ladder user.

Other and further objects and advantages of the present invention will be apparent from the following detailed description, drawings and claims.

Other embodiments of this invention utilizing the same or equivalent principles may be used and structural changes may be made as desired by those skilled in the art without departing from the present invention and the purview of the appended claims.

BRIEF DESCRIPTION OF THE DRAWING

Referring now to the drawings wherein like parts are referred to by like alphanumeric characters throught out.

Figure 1:
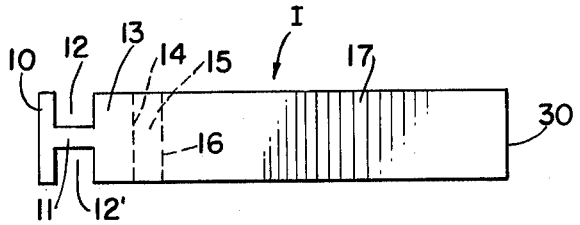
FIG. 1 is a plan view of a presently preferred embodiment of the caulking gun holder for an extension ladder as cut or stamped from a sheet of metal.
Figure 4:
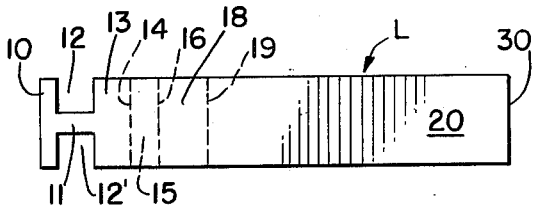
FIG. 4 is a plan view of another embodiment of the present invention for use upon an extension ladder as cut or stamped from a sheet of metal.
Figure 2:
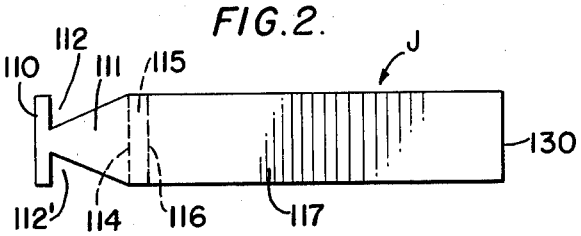
FIG. 2 is a plan view of a presently preferred embodiment of the caulking gun holder for a step ladder as cut or stamped from a sheet of metal.
Figure 5:
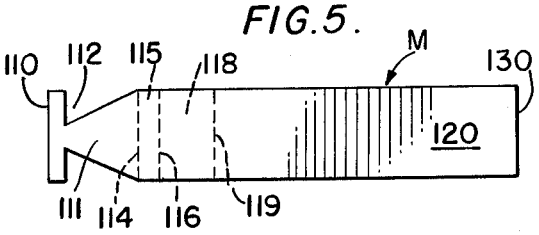
FIG. 5 is a plan view of another embodiment of the present invention for use upon a step ladder as cut or stamped from a sheet of metal.
Figure 3:
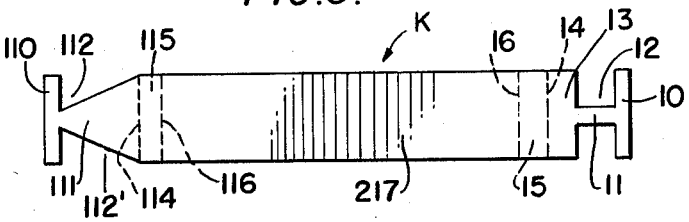
FIG. 3 is a plan view of a presently preferred embodiment of the caulking gun holder for an extension ladder and for a step ladder as cut or stamped from a sheet of metal.
Figure 7:
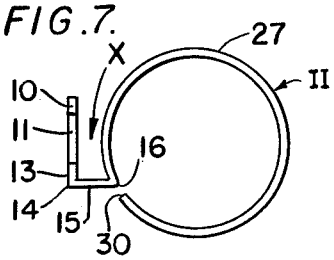
FIG. 7 is a top or bottom plan view of the caulking gun holder for an extension ladder as it would be seen from above or below as made from FIG. 1 and which shows an arcuately formed flange that when mounted upon an extension ladder would be spring loaded against the side of the rail of the extension ladder.
Figure 6:
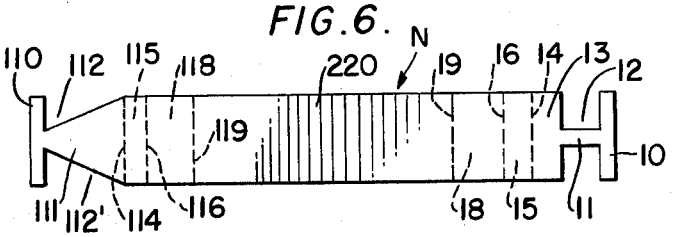
FIG. 6 is a plan view of another embodiment of the present invention for use upon an extension ladder and a step ladder as cut or stamped from a sheet of metal.
Figure 8:
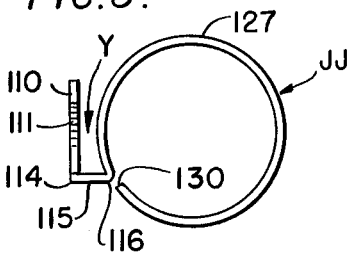
FIG. 8 is a top or bottom plan view of the caulking gun holder for a step ladder as it would be seen from above or below as made from FIG. 2 and which shows an arcuately formed flange that when mounted upon a step ladder would be spring loaded against the side of the rail of the step ladder.
Figure 9:
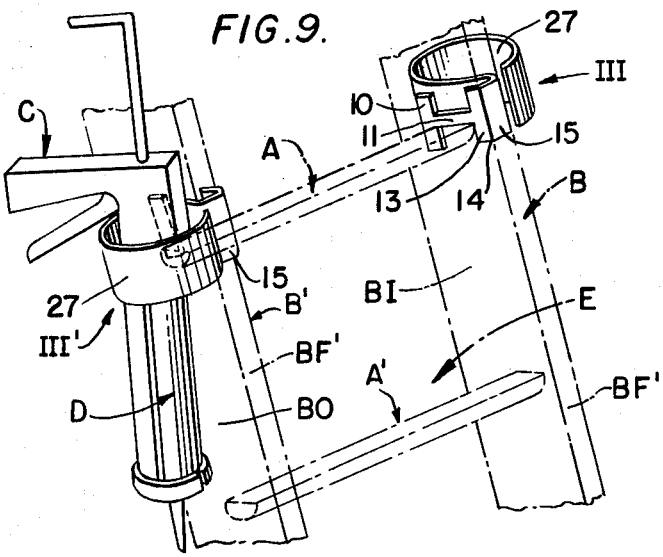
FIG. 9 is a perspective view of an extension ladder with a caulking gun holder mounted upon the left rail and a caulking gun holder mounted upon the right rail and both made from FIG. 1 together with a caulking gun supported within the leftmost caulking gun holder.
Figure 10:
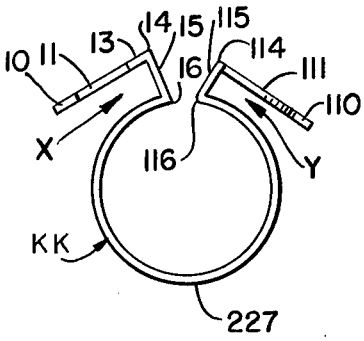
FIG. 10 is a top or bottom plan view of the caulking gun holder for an extension ladder and for a step ladder as made from FIG. 3 as it would be seen from above when mounted upon a ladder or when seen from below and showing arcuately formed flanges.
Figure 11:
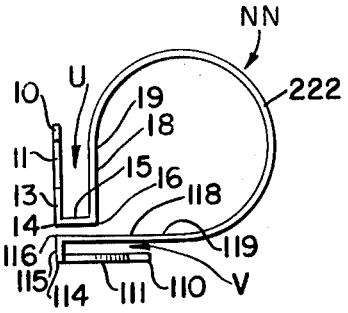
FIG. 11 is a top or bottom plan view of the caulking gun holder for an extension ladder and for a step ladder as made from FIG. 6 as it would be seen from above when mounted upon a ladder or when seen from below and showing parallel flanges.
Figure 12:
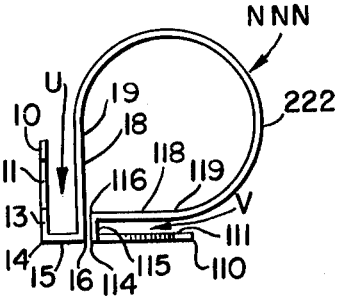
FIG. 12 is another modification of FIG. 11 of a caulking gun holder for an extension ladder and for a step ladder as made from FIG. 6 as it would be seen from above when mounted upon a ladder or when seen from below and showing parallel flanges.
Figure 13:
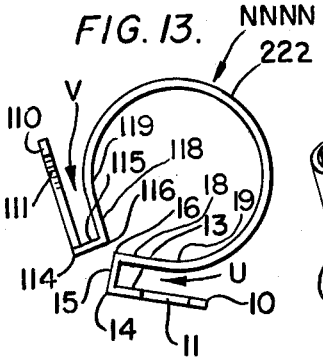
FIG. 13 is still another modification of FIG. 11 of a caulking gun holder for an extension ladder and for a step ladder as made from FIG. 6 as it would be seen from above when mounted upon a ladder or from below and again showing parallel flanges.
Figure 14:
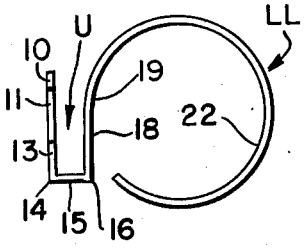
FIG. 14 is a top or bottom plan view of the caulking gun holder for an extension ladder as made from FIG. 4 and which shows parallel flanges.
Figure 15:
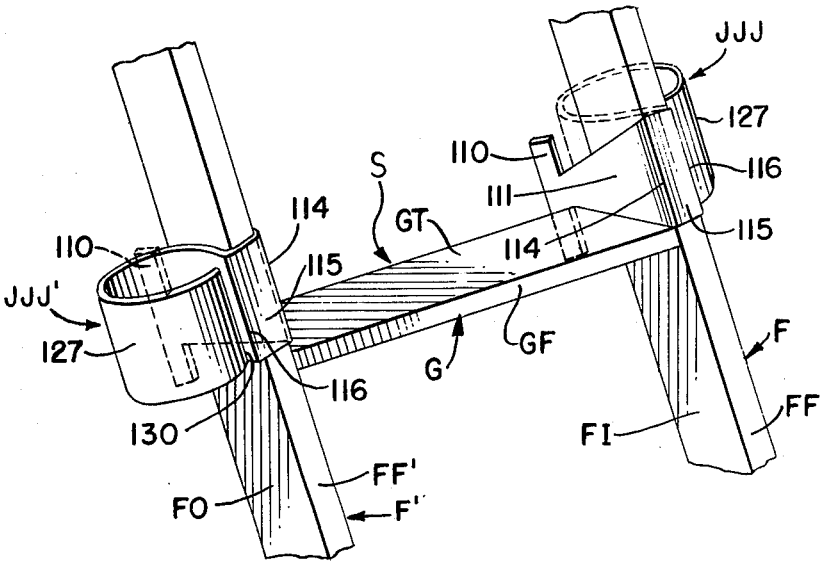
FIG. 15 is a perspective view of a step ladder with a caulking gun holder for a step ladder mounted upon the left rail and a caulking gun holder for a step ladder mounted upon the right rail and both made from FIG. 2 and both showing an arcuately formed flange.
Figure 16:
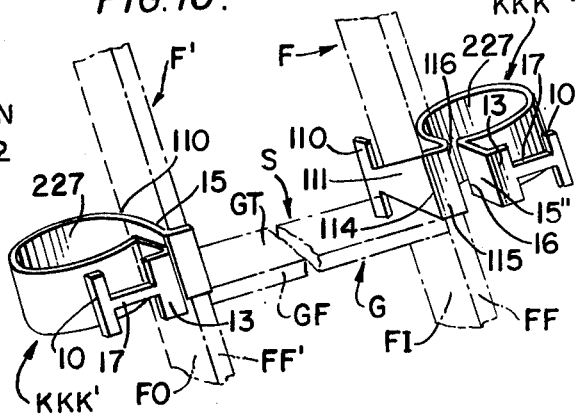
FIG. 16 is a perspective view of a step ladder with a caulking gun holder for an extension ladder and for a step ladder as made from FIG. 3 mounted upon the left and right rails, and both showing arcuately formed flanges.
Figure 18:
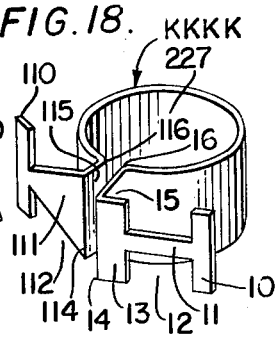
FIG. 18 is a perspective view of a caulking gun holder for an extension ladder and for a step ladder as made from FIG. 3 showing an arcuately formed flange for both the extension ladder attachment means and for the step ladder attachment means.
Figure 19:
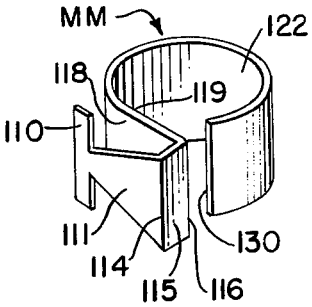
FIG. 19 is a perspective view of a caulking gun holder for a step ladder as made from FIG. 5 showing parallel flanges.
Figure 17:
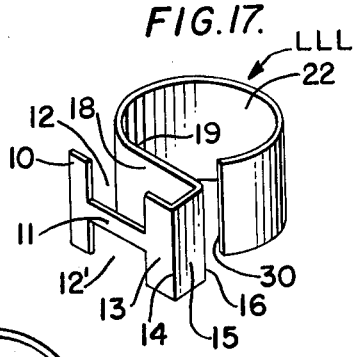
FIG. 17 is a perspective view of a caulking gun holder for an extension ladder as made from FIG. 4 showing parallel flanges.
Figure 20:
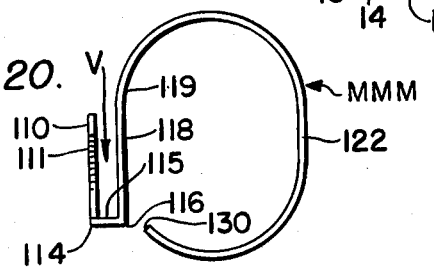
FIG. 20 is a top or bottom plan view of still another modification of the caulking gun holder for a step ladder of FIG. 19 as made from FIG. 5 showing parallel flanges and an oblong caulking gun receiving means.

S-heet metal blank I of FIG. 1 is formed by bending into the spring loaded arcuately formed flanged caulking gun holder for an extension ladder, as shown in:

II of FIG. 7,
III of FIG. 9,
and III' of FIG. 9;

Sheet metal blank J of FIG. 2 is formed by bending into the spring loaded arcuately formed flanged caulking gun holder for a step ladder, as shown in:

JJ of FIG. 8,
JJJ of FIG. 15,
and JJJ' of FIG. 15;

Sheet metal blank K of FIG. 3 is formed by bending into the spring loaded arcuately formed flanged caulking gun holder for an extension ladder and for a step ladder, as shown in:

KK of FIG. 10,
KKK of FIG. 16,
KKK' of FIG. 16,
and KKKK of FIG. 18;

Sheet metal blank L of FIG. 4 is formed by bending into the parallel flanged caulking gun holder for an extension ladder, as shown in:

LL of FIG. 14,
and LLL of FIG. 17;

Sheet metal blank M of FIG. 5 is formed by bending into the parallel flanged caulking gun holder for a step ladder, as shown in:

MM of FIG. 19,
and MMM of FIG. 20;

Sheet metal blank N of FIG. 6 is formed by bending into the parallel flanged caulking gun holder for an extension ladder and for a step ladder, as shown in:

NN of FIG. 11,
NNN of FIG. 12,
and NNNN of FIG. 13.

For further clarity, and referring to the drawings, the:

Letters A and A' refer to the steps or rungs of an extension ladder, as shown in FIG. 9;

Letters B and B' refer to the vertical rails or stiles of an extension ladder, as shown in FIG. 9;

Mnemonics BF and BF' refer to the forward edges of the vertical rails or stiles of an extension ladder, as shown in FIG. 9;

Mnemonic BI refers to the inside face of the vertical rail of the extension ladder, as shown in FIG. 9;

Mnemonic BO refers to the outside face of the vertical rail of the extension ladder, as shown in FIG. 9;

Letter C refers to a caulking gun, as shown in FIG. 9;

Letter D refers to a caulking tube, as shown in FIG. 9;

Letter E refers to the extension ladder, as shown in FIG. 9;

Letters F and F' refer to the vertical rails or stiles of the step ladder, as shown in FIG. 15;

Mnemonics FF and FF' refer to the forward edges of the vertical rails of the step ladder, as shown in FIGS. 15 and 16;

Mnemonic FI refers to the inside face of the vertical rail of the step ladder, as shown in FIGS. 15 and 16;

Mnemonic FO refers to the outside face of the vertical rail of the step ladder, as shown in FIGS. 15 and 16;

Letter G refers to the step or rung of a step ladder, as shown in FIGS. 15 and 16;

Mnemonic GF refers to the forward edge of the step of the step ladder, as shown in FIGS. 15 and 16;

Mnemonic GT refers to the top face of the step of the step ladder, as shown in FIGS. 15 and 16;

Letter S refers to the step ladder, as shown in FIGS. 15 and 16;

Letter U refers to the parallel flanged extension ladder attachment means, as shown in FIGS. 11, 12, 13 and 14;

Letter V refers to the parallel flanged step ladder attachment means, as shown in FIGS. 11, 12, 13 and 20;

Letter X refers to the spring loaded arcuately formed flanged attachment means for an extension ladder, as shown in FIGS. 7, and 10;

Letter Y refers to the spring loaded arcuately formed flanged attachment means for a step ladder, as shown in FIGS. 8 and 10.

A DETAILED DESCRIPTION OF THE DRAWINGS

Referring now to the drawings in detail wherein like parts are referred to by like numerals throughout, FIG. 1 illustrates a single sheet metal blank I which may be utilized to fabricate the Caulking Gun Holder for an extension ladder of the present invention. Sheet metal blank I of FIG. 1 is preferably given the illustrated pattern by stamping. When appropriately bent along the dotted lines 14 and 16 of FIG. 1, and when member 17 is appropriately arcuately formed into the caulking gun retaining means 27 of FIGS. 7 and 9, blank I will be fabricated into a Caulking Gun Holder II of FIG. 7 or into III & III' of FIG. 9 for an extension ladder E in FIG. 9 having the configuration illustrated in FIGS. 7 and 9, so as (1) to to permit being hooked over the top of a selected rung A or A' of an extension ladder E in FIG. 9, (2) to circumscribe three sides BI, BF, and BO of rail B of the extension ladder E as shown in FIG. 9, (3) to engage the caulking gun C containing the caulking tube D as shown in FIG. 9, and (4) to support the caulking gun C as shown in FIG. 9.

Fabrication of blank I of FIG. 1 into the configuration of the Caulking Gun Holder for an extension ladder E of FIG. 9 may be economically achieved by bending blank I along dotted lines 14 and 16 into an essentially hook shaped rail receiving recess X illustrated by walls 13, 15 and 27 in FIGS. 7 and 9. The blank I provides recesses 12 and 12' for receiving an extension ladder step A or A' of extension ladder E as shown in FIG. 9.

The recesses 12 and 12' for receiving an extension ladder step A or A' in FIG. 9 are integrally formed from members 10, 11 and 13 of blank I. Furthermore, members 10, 11 and 13 integrally form one flange of the rail receiving recess X as shown in FIG. 7. Extension 17 is arcuately formed into a caulking gun receiving means 27 as shown in FIGS. 7 and 9 with edge 30 adjacent to bend 16. By bending bend 16 by more than 90 degrees a spring loaded flange 27 is produced from web 15 and the caulking gun receiving means 27.

Hence, it is seen from the foregoing detailed description of the Caulking Gun Holder for an extension ladder, II in FIG. 7 and III & III' in FIG. 9 that a rail receiving structure or recess X is formed from walls 13, 15 and 17 to produce walls 13, 15 and 27 as shown in FIGS. 7 and 9; and that a step receiving structure or recesses 12 and 12' is integrally formed from extensions 10, 11 and 13; and further that the extension 17 of FIG. 1 makes up part of the wall or arcuately formed flange 27 of FIGS. 7 and 9 and the arcuately formed flange or wall 27 is also the support member into which the caulking gun C is contained, thereby signifying that extension 17 has a dual purpose when arcuately formed into the caulking gun receiving means or support holder 27.

FIG. 2 illustrates a single sheet metal blank J which may be utilized to fabricate the Caulking Gun Holder for a step ladder of the present invention. Sheet metal blank J of FIG. 2 is preferably given the illustrated pattern by stamping. When appropriately bent along the dotted lines 114 and 116 of FIG. 2, and when member 117 is appropriately arcuately formed into the caulking gun retaining means 127 of FIGS. 8 and 15, blank J will be fabricated into the Caulking Gun Holder JJ of FIG. 8 or into JJJ or JJJ' of FIG. 15 for a step ladder S in FIGS. 15 and 16 having the configuration illustrated in FIGS. 8 and 15, so as to (1) to permit being hooked over the top of a selected step G of a step ladder S in FIG. 15, (2) to circumscribe three sides FI, FO, and FF of rail F of the step ladder S as shown in FIG. 15, (3) to engage the caulking gun C containing the caulking tube D (as shown in FIG. 9), and (4) to support the caulking gun C (as shown in FIG. 9).

Fabrication of blank J of FIG. 2 into the configuration of the Caulking Gun Holder for a step ladder S of FIG. 15 may be economically achieved by bending blank J along dotted lines 114 and 116 into an essentially hook shaped rail receiving recess Y illustrated by walls 111, 115 and 127 in FIGS. 8 and 15. The blank J provides recesses 112 and 112' for receiving a step ladder step G of step ladder S as shown in FIG. 15.

The recesses 112 and 112' for receiving a step ladder step G in FIG. 15 are integrally formed from members 110 and 111 of blank J. Furthermore, members 110 and 111 integrally form one flange of the rail receiving recess Y as shown in FIG. 8. Extension 117 in FIG. 2 is arcuately formed into a caulking gun receiving means 127 as shown in FIGS. 8 and 15 with edge 130 adjacent to bend 116.

Hence, it is seen from the foregoing detailed description that the Caulking Gun Holder for a step ladder JJ in FIG. 8 and JJJ & JJJ' in FIG. 15 provides for a rail receiving structure or recess Y formed from walls 111, 115, and 117 to produce walls 111, 115, and 127 as shown in FIGS. 8 and 15, and a step receiving structure or recesses 112 and 112' integrally formed from extensions 110 and 111; and further that the extension 117 of FIG. 2 makes up part of the wall or arcuately formed flange 127 of FIGS. 8 and 15, and the arcuately formed flange or wall is also the support member into which the caulking gun C is contained, and further that the arcuately formed flange or wall is preferable bent more than 90° at bend 116 thereby producing a spring loaded arcuately formed flanged rail receiving recess Y that is spring loaded upon a rail F as shown in FIG. 15; thereby signifying that extension 127 has a triple purpose when arcuately formed into the caulking gun receiving means or support holder shown in FIGS. 8 and 15.

FIG. 3 illustrates a single sheet metal blank K which may be utilized to fabricate a Caulking Gun Holder for an extension ladder or for a step ladder of the present invention. Sheet metal blank K of FIG. 3 is preferably given the illustrated pattern by stamping. Sheet metal blank K contains the same subcomponents as in I in FIG. 1, namely 10 thru 16, and when suitably bent, as described below, components 10 thru 16 produce an extension ladder attachment means X, as shown in FIGS. 10 and 16. Sheet metal blank K also contains the same subcomponents as in blank J of FIG. 2, namely 110 thru 116, and when suitably bent, as described below, components 110 thru 116 produce a step ladder attachment means Y, again as shown in FIGS. 10 and 16. Sheet metal blank K may be thought of as sheet metal blank I, in FIG. 1, joined or connected at edge 30 to edge 130 of sheet metal blank J in FIG. 2. In the alternative, one can picture edge 30 of blank I in FIG. 1 to be connected to bend 116 of FIG. 2, with member 117 either now replaced or considered to be part and parcel of member 217 in FIG. 3. In a like manner, one can picture edge 130 of sheet metal J in FIG. 2 to be connected to bend 16 of FIG. 1, with now member 17 either now replaced or considered to be part and parcel of member 217 in FIG. 3. Members 10 thru 16, when suitably bent, together with arcuately formed member 227 (in FIGS. 10 and 16), produce the spring loaded arcuately formed extension ladder attachment means X; and members 110 thru 116, when suitably bent, produce the spring loaded arcuately formed step ladder attachment means Y, all as shown in FIGS. 10 and 16.

When appropriately bent along the dotted lines 14 and 16 of FIG. 3, and when member 217 is appropriately arcuately formed into the caulking gun retaining means 227 of FIGS. 10 and 16, blank K will be fabricated into a Caulking Gun Holder KK of FIG. 10 or KKK or KKK' of FIG. 16 for the extension ladder portion having the configuration illustrated at X in FIG. 10, so as to (1) to permit being hooked over the top of a selected step or rung A or A' of an extension ladder E (in FIG. 9), (2) to circumscribe three sides BI, BF, and BO of rail B and B' of the extension ladder E (as shown in FIG. 9), (3) to engage the caulking gun C containing the caulking tube D (as shown in FIG. 9), and (4) to support the caulking gun C (as shown in FIG. 9).

Fabrication of blank K of FIG. 3 into the portion of the Caulking Gun Holder for an extension ladder E (of FIG. 9) may be economically achieved by bending blank K along dotted lines 14 and 16 into an essentially hook shaped rail receiving recess X illustrated by walls 11, 13, 15 and 227 in FIG. 10. The bend at 14 in FIGS. 10 and 16 is preferably at 90°. The bend at 16 is preferably greater than 90°, thereby producing a spring loaded arcuately formed flange 227 and integrally formed flange 10, 11 and 13 opposed to each other, and connected by web 15. Member 217 in FIG. 3 is arcuately formed, starting at bend 16, into member 227 as shown in FIGS. 10 and 16, thereby producing an arcuately formed caulking gun support member for holding or supporting a caulking gun when mounted therein. Furthermore, the blank K provides recesses 12 and 12' for receiving an extension ladder's step A or A' of extension ladder E (as shown in FIG. 9).

The recesses 12 and 12' for receiving an extension ladder's step or rung A or A' (in FIG. 9) are integrally formed from members 10, 11 and 13 of blank K. Furthermore, members 10, 11 and 13 integrally form one flange of the rail receiving recess X (as shown in FIGS. 10 and 16). Extension 217 is arcuately formed, starting at bend 16 and ending at bend 116, into a caulking gun receiving means as shown in FIG. 10 with bend 116 adjacent to bend 16 in FIG. 10.

In a like manner to what was done to sheet metal blank I of FIG. 1, when sheet metal K is appropriately bent along the dotted lines 114 and 116 of FIG. 3, (and when member 217 is appropriately arcuately formed into the caulking gun retaining means 227 of FIGS. 10 and 16), blank K will be fabricated into a Caulking Gun Holder KK of FIG. 10, or into KKK or KKK' of FIG. 16 for the step ladder portion Y, having the configuration illustrated, so as to (1) to permit being hooked over the top of a selected step G of a step ladder S (in FIGS. 15 and 16), (2) to circumscribe three sides FI, FO, and FF of rail F of the step ladder S (as shown in FIGS. 15 and 16), (3) to engage the caulking gun C containing the caulking tube D (as shown in FIG. 9), and (4) to support the caulking gun C (as shown in FIG. 9).

Fabrication of blank K of FIG. 3 into the portion of the Caulking Gun Holder for a step ladder S of FIGS. 15 and 16 may be economically achieved by bending blank K along dotted lines 114 and 116 into an essentially hook shaped rail receiving recess Y illustrated by walls 111, 115 and arcuately formed member 227 in FIGS. 10 and 16. The bend at 114 in FIGS. 10 and 16 is preferably at 90°, while the bend at 116 is preferably greater than 90°, thereby producing flange 227 and integral flange 111 and 110 opposed to each other, and connected by web 115. Member 217 in FIG. 3 is arcuately formed, starting at bend 116, into member 227 as shown in FIGS. 10 and 16; thereby producing an arcuately formed caulking gun support member for holding or supporting a caulking gun when mounted therein. Furthermore, the blank K provides recesses 112 and 112' for receiving a step ladder's step G of step ladder S (as shown in FIGS. 15 and 16).

The recesses 112 and 112' for receiving a step ladder step G (in FIG. 15) are integrally formed from members 110 and 111 of blank K. Furthermore, members 110 and 111 integrally form one flange of the rail receiving recess Y (as shown in FIGS. 10 and 16). Extension 217 is arcuately formed, starting at bend 116, into a caulking gun receiving means as shown in FIGS. 10 and 16 with bend 116 adjacent to bend 16 in FIG. 10.

Hence, it is seen from the foregoing detailed description of the Caulking Gun Holder for an extension ladder or for a step ladder, KK in FIG. 10, or KKK or KKK' in FIG. 16, that they provide for a rail receiving structure or recess Y suitable for a step ladder's rail and formed from walls 111 and 227, and connecting web 115; to produce a spring loaded arcuately formed rail receiving recess flange Y; together with a rail receiving structure or recess X suitable for an extension ladder's rail and formed from walls 11 and 227, and connecting web 15 to produce a spring loaded arcuately formed extension ladder rail receiving recess X, all shown in FIGS. 10 and 16. Furthermore, a step ladder's step receiving recess 112 or 112' is integrally formed from extensions 110 and 111, while the extension ladder's step receiving recess 12 or 12' is integrally formed from extensions 10, 11 and 13. Finally, member 217 of FIG. 3 is arcuately formed into the caulking gun retaining means 227, as shown in FIGS. 10 and 16, and into which the caulking gun C is contained when mounted therein.

FIG. 4 illustrates a single sheet metal blank L which may be utilized to fabricate another embodiment of the Caulking Gun Holder for an extension ladder of the present invention. Sheet metal blank L of FIG. 4 is preferably given the illustrated pattern by stamping. When appropriately bent along the dotted lines 14, 16, and 19 of FIG. 4, and when member 20 is appropriately arcuately formed into the caulking gun retaining means 22 of FIGS. 14 and 17, blank L will be fabricated into a Caulking Gun Holder LL of FIG. 14 or into LLL of FIG. 17 for an extension ladder E (in FIG. 9) having the configuration illustrated in FIGS. 14 and 17 so as to (1) to permit being hooked over the top of a selected step or rung A or A' of an extension ladder E (in FIG. 9), (2) to circumscribe three sides BI, BF, and BO of rail B and B' of the extension ladder E (as shown in FIG. 9), (3) to engage the caulking gun C containing the caulking tube D (as shown in FIG. 9), and (4) to support the caulking gun C (as shown in FIG. 9).

Fabrication of blank L of FIG. 4 into the configuration of the Caulking Gun Holder for an extension ladder E (of FIG. 9) may be economically achieved by bending blank L along dotted lines 14 and 16 into an essentially hook shaped rail receiving recess U illustrated by walls 11, 15 and 18 in FIGS. 11, 12 and 13. The bends at 14 and 16 in FIGS. 14 and 17 are preferably at 90° thereby producing flanges 18 and integral flange 11 and 10 parallel to each other, and connected by web 15. Member 20 in FIG. 4 is arcuately formed, starting at bend 19, into member 22 as shown in FIG. 14 or in FIG. 17; thereby producing an arcuately formed caulking gun support member 22 for holding or supporting a caulking gun when mounted therein. Furthermore, the blank L provides recesses 12 and 12' for receiving an extension ladder's step A or A' of extension ladder E (as shown in FIG. 9).

The recesses 12 and 12' for receiving an extension ladder's step or rung A or A' (in FIG. 9) are integrally formed from members 10 and 11 of blank L. Furthermore, members 10 and 11 integrally form one flange of the rail receiving recess U (as shown in FIGS. 11, 12 and 13). Extension 20 is arcuately formed, starting at bend 19, into a caulking gun receiving means 22 as shown in FIGS. 14 and 17 with edge 30 adjacent to bend 16. After bending bends 14 and 16 at preferably a right angle, member 18 becomes parallel to member 11, as shown in FIG. 14, and thereby forms a parallel flanged rail receiving attachment means U, which is illustrated in FIGS. 11, 12 and 13.

Hence, it is seen from the foregoing detailed description of another embodiment of the Caulking Gun Holder for an extension ladder, LL in FIG. 14 and LLL in FIG. 17 provide for a rail receiving structure or recess U formed from walls 11, 15 and 18 to produce parallel flanges 11 and 18, and connecting web 15 as shown in FIGS. 14 and 17, and a step receiving structure or recesses 12 and 12' integrally formed from extensions 10 and 11; and further that the extension 20 of FIG. 4 makes up part of the wall or arcuately formed caulking gun retaining means 22 of FIGS. 14 and 17 into which the caulking gun C is contained when mounted therein.

FIG. 5 illustrates a single sheet metal blank M which may be utilized to fabricate another embodiment of the Caulking Gun Holder for a step ladder of the present invention. Sheet metal blank M of FIG. 5 is preferably given the illustrated pattern by stamping. When appropriately bent along the dotted lines 114, 116 and 119 of FIG. 5, and when member 120 is appropriately arcuately formed into the caulking gun retaining means 122 of FIGS. 19 and 20, blank M will be fabricated into a Caulking Gun Holder MM of FIG. 19 or into MMM of FIG. 20 for a step ladder S (in FIGS. 15 and 16) having the configuration illustrated in FIGS. 19 and 20, so as to (1) to permit being hooked over the top of a selected step G of a step ladder S (in FIGS. 15 and 16), (2) to circumscribe three sides FI, FO, and FF of rail F of the step ladder S (as shown in FIGS. 15 and 16), (3) to engage the caulking gun C containing the caulking tube D (as shown in FIG. 9), and (4) to support the caulking gun C (as shown in FIG. 9).

Fabrication of blank M of FIG. 5 into the configuration of the Caulking Gun Holder for a step ladder S (of FIGS. 15 and 16) may be economically achieved by bending blank M along dotted lines 114 and 116 into an essentially hook shaped rail receiving recess V illustrated by walls 111, 115 and 118 in FIGS. 11, 12 and 13. The bends at 114 and 116 in FIGS. 19 and 20 are preferably at 90° thereby producing flange 118 and integral flange 111 and 110 parallel to each other, and connected by web 115. Member 120 in FIG. 5 is arcuately formed, starting at bend 119, into member 122 as shown in FIG. 19 or in FIG. 20; thereby producing an arcuately formed caulking gun support member 122 for holding or supporting a caulking gun when mounted therein. Furthermore, the blank M provides recesses 112 and 112' for receiving a step ladder's step G of step ladder S (as shown in FIGS. 15 and 16).

The recesses 112 and 112' for receiving a step ladder step G (in FIG. 15) are integrally formed from members 110 and 111 of blank M. Furthermore, members 110 and 111 integrally form one flange of the rail receiving recess V (as shown in FIGS. 11, 12 and 13). Extension 120 is arcuately formed, starting at bend 119, into a caulking gun receiving means 222 as shown in FIGS. 19 and 20 with edge 130 adjacent to bend 116. After bending bends 114 and 116 at preferably a right angle, member 118 becomes parallel to member 111, as shown in FIG. 20, and thereby forms a parallel flanged rail receiving attachment means V, which is illustrated in FIGS. 11, 12 and 13.

Hence, it is seen from the foregoing detailed description of another embodiment of the Caulking Gun Holder for a step ladder, MM in FIG. 19 and MMM in FIG. 20 provide for a rail receiving structure or recess V formed from walls 111, 115 and 118 to produce parallel flanges 111 and 118, and connecting web 115 as shown in FIGS. 19 and 20, and a step receiving structure or recesses 112 and 112' integrally formed from extensions 110 and 111; and further that the extension 120 of FIG. 5 makes up part of the wall or arcuately formed caulking gun retaining means 122 of FIGS. 19 and 20 into which the caulking gun C is contained when mounted therein.

FIG. 6 illustrates a single sheet metal blank N which may be utilized to fabricate another embodiment of the Caulking Gun Holder for an extension ladder or for a step ladder of the present invention. Sheet metal blank N of FIG. 6 is preferably given the illustrated pattern by stamping. Sheet metal blank N contains the same subcomponents as in Blank L of FIG. 4, namely 10 thru 19, and when suitably bent, as described below, components 10 thru 19 produce an extension ladder attachment means U, as shown in FIGS. 11, 12 and 13. Sheet metal blank N also contains the same subcomponents as in blank M of FIG. 5, namely 110 thru 119, and when suitably bent, as described below, components 110 thru 119 produce a step ladder attachment means V, again as shown in FIGS. 11, 12 and 13. Sheet metal blank N may be thought of as sheet metal blank L, in FIG. 4, joined or connected at edge 30 to edge 130 of sheet metal blank M in FIG. 5. In the alternative, one can picture edge 30 of blank L in FIG. 4 to be connected to bend 119 of FIG. 5, with member 120 either now replaced or considered to be part and parcel of member 220 in FIG. 6. In a like manner, one can picture edge 130 of sheet metal M in FIG. 5 to be connected to bend 19 of FIG. 4, with now member 20 either now replaced or considered to be part and parcel of member 220 in FIG. 6. Members 10 thru 19, when suitably bent, produce the parallel flanged extension ladder attachment means U; and members 110 thru 119, when suitably bent, produce the parallel flanged step ladder attachment means V, all as shown in FIGS. 11, 12 and 13.

When appropriately bent along the dotted lines 14, 16, and 19 of FIG. 6, and when member 220 is appropriately arcuately formed into the caulking gun retaining means 222 of FIGS. 11, 12 and 13, blank N will be frabricated into a Caulking Gun Holder NN of FIG. 11, NNN of FIG. 12 or NNNN of FIG. 13 for the extension ladder portion having the configuration illustrated at U in FIGS. 11, 12 and 13, so as to (1) to permit being hooked over the top of a selected step or rung A or A' of an extension ladder E (in FIG. 9), (2) to circumscribe three sides BI, BF, and BO of rail B and B' of the extension ladder E (as shown in FIG. 9), (3) to engage the caulking gun C containing the caulking tube D (as shown in FIG. 9), and (4) to support the caulking gun C (as shown in FIG. 9).

Fabrication of blank N of FIG. 6 into the portion of the Caulking Gun Holder for an extension ladder E (of FIG. 9) may be economically achieved by bending blank N along dotted lines 14 and 16 into an essentially hook shaped rail receiving recess U illustrated by walls 11, 15 and 18 in FIGS. 11, 12 and 13. The bends at 14 and 16 in FIGS. 11, 12 and 13 are preferably at 90° thereby producing flanges 18 and integral flange 11 and 10 parallel to each other, and connected by web 15. Member 220 in FIG. 6 is arcuately formed, starting at bend 19, into member 222 as shown in FIGS. 11, 12 or 13; thereby producing an arcuately formed caulking gun support member 222 for holding or supporting a caulking gun when mounted therein. Furthermore, the blank N provides recesses 12 and 12' for receiving an extension ladder's step A or A' of extension ladder E (as shown in FIG. 9).

The recesses 12 and 12' for receiving an extension ladder's step or rung A or A' (in FIG. 9) are integally formed from members 10 and 11 of blank N. Furthermore, members 10 and 11 integrally form one flange of the rail receiving recess U (as shown in FIGS. 11, 12 and 13). Extension 220 is arcuately formed, starting at bend 19, into a caulking gun receiving means as shown in FIGS. 11, 12 and 13 with bend 116 adjacent to bend 14 in FIG. 11, or with bend 16 adjacent to bend 114 in FIG. 12, or alternately, with bend 116 adjacent to bend 16, as shown in FIG. 13. After bending bends 14 and 16 at preferably a right angle, member 18 becomes parallel to member 11, as shown in FIGS. 11, 12 and 13, and thereby forms a parallel flanged rail receiving attachment means U for an extension ladder, which is illustrated in FIGS. 11, 12 and 13.

In a like manner to what was done to sheet metal blank L of FIG. 4, when sheet metal N is appropriately bent along the dotted lines 114, 116 and 119 of FIG. 6, (and when member 220 is appropriately arcuately formed into the caulking gun retaining means 222 of FIGS. 11, 12 and 13), blank N will be fabricated into a Caulking Gun Holder NN of FIG. 11, or into NNN of FIG. 12 or into NNNN of FIG. 13 for the step ladder portion V, having the configuration illustrated, so as to (1) to permit being hooked over the top of a selected step G of a step ladder S (in FIGS. 15 and 16), (2) to circumscribe three sides FI, FO, and FF of rail F of the step ladder S (as shown in FIGS. 15 and 16), (3) to engage the caulking gun C containing the caulking tube D (as shown in FIG. 9), and (4) to support the caulking gun C (as shown in FIG. 9).

Fabrication of blank N of FIG. 6 into the portion of the Caulking Gun Holder for a step ladder S of FIGS. 15 and 16 may be economically achieved by bending blank N along dotted lines 114 and 116 into an essentially hook shaped rail receiving recess V illustrated by walls 111, 115 and 118 in FIGS. 11, 12 and 13. The bends at 114 and 116 in FIGS. 11, 12 and 13 are preferably at 90° thereby producing flange 118 and integral flange 111 and 110 parallel to each other, and connected by web 115. Member 220 in FIG. 6 is arcuately formed, starting at bend 119, into member 222 as shown in FIGS. 11, 12 and in 13; thereby producing an arcuately formed caulking gun support member for holding or supporting a caulking gun when mounted therein. Furthermore, the blank N provides recesses 112 and 112' for receiving a step ladder's step G of step ladder S (as shown in FIGS. 15 and 16).

The recesses 112 and 112' for receiving a step ladder step G (in FIG. 15) are integrally formed from members 110 and 111 of blank N. Furthermore, members 110 and 111 integrally form one flange of the rail receiving recess V (as shown in FIGS. 11, 12 and 13). Extension 220 is arcuately formed, starting at bend 119, into a caulking gun receiving means as shown in FIGS. 11, 12 and 13 with bend 116 adjacent to bend 14 in FIG. 11, or with bend 16 adjacent to bend 114 in FIG. 12, or alternately, with bend 116 adjacent to bend 16, as shown in FIG. 13. After bending bends 114 and 116 at preferably a right angle, member 118 becomes parallel to member 111, as shown in FIGS. 11, 12 and 13, and thereby forms a parallel flanged rail receiving attachment means V, suitable for a step ladder and illustrated in FIGS. 11, 12 and 13.

Hence, it is seen from the foregoing detailed description of another embodiment of the Caulking Gun Holder for an extension ladder or for a step ladder, NN in FIG. 11, NNN in FIG. 12, or NNNN in FIG. 13, that they provide for a rail receiving structure or recess V suitable for a step ladder and formed from walls 111, 115 and 118 to produce parallel flanges 111 and 118, and connecting web 115; together with a rail receiving structure or recess U suitable for an extension ladder and formed from walls 11, 15 and 18 to produce, this time, parallel flanges 11 and 18, together with the connecting web 15 joining flanges 11 and 18, all as shown in FIGS. 11, 12 and 13. Furthermore, a step ladder's step receiving recess 112 or 112' is integrally formed from extensions 110 and 111, while the extension ladder's step receiving recess 12 or 12' is integrally formed from extensions 10, 11 and 13. Finally, member 220 of FIG. 6 is arcuately formed into the caulking gun retaining means 222, as shown in FIGS. 11, 12 and 13, and into which the caulking gun C is contained when mounted therein.

FIG. 7 is a top or bottom plan view of the caulking gun holder for an extension ladder as it would be seen from above or below as made from sheet metal blank I, as in FIG. 1, and which shows an arcuately formed flange that when mounted upon an extension ladder would be spring loaded against the side of the rail of the extension ladder. Reversible finger 10, reversible step resting member 11 and connecting member 13 integrally form a flange that is at right angles to the connecting web 15. Connecting web 15 is bent at bend 16 and is connected to the arcuately formed flange and caulking gun support member 27 at an acute angle thereto, thereby producing a spring loaded action within the rail receiving recess X.

FIG. 8 is a top or bottom plan view of the caulking gun holder for a step ladder as it would be seen from above or below as made from sheet metal blank J, as in FIG. 2, and which shows an arcuately formed flange that when mounted upon a step ladder would be spring loaded against the side of the rail of the step ladder. Reversible finger 110 and reversible step resting member 111 integrally form a flange that is at right angles to the connecting web at bend 114. Connecting web 115 is bent at an acute angle at 116 and is connected to the arcuately formed flange and caulking gun support member 127, thereby producing a spring loaded action within the step ladder rail receiving recess Y.

FIG. 9 is a perspective view of an extension ladder with a caulking gun holder mounted upon the left rail and a caulking gun holder mounted upon the right rail and both made from sheet metal blank I, as in FIG. 1, together with a caulking gun supported within the leftmost Caulking Gun Holder. Reversible finger 10, reversible step resting member 11 and connecting member 13 integrally form a flange that is joined at bend 14 at right angles to connecting web 15. Connecting web 15 is joined at bend 16 at an acute angle to the arcuately formed flange and caulking gun support member 27. To place the Caulking Gun Holder upon the extension ladder, one slides the rail receiving recess X over rail B or B' until web 15 meets the forward edge of the vertical rail BF or BF'. One then slides the Caulking Gun Holder vertically downward until the step receiving recess 12 or 12', integrally formed from members 10, 11 and 13, sits upon a rung or step A or A'. The caulking gun is placed into the caulking gun support member 27 by vertically placeing the caulking gun into the arcuately formed flange and caulking gun support member 27. Since III and III' are superimposable, the reversibility of III and III' can readily be seen.

FIG. 10 is a top or bottom plan view of the Caulking Gun Holder for an extension ladder or for a step ladder as made from FIG. 3 as it would be seen from above when mounted upon a ladder or when seen from below and showing arcuately formed flanges. Reversible finger 10, step resting member 11 and connecting member 13 integrally form a flange that is connected at a right angle to web 15. Web 15 is connected at bend 16 at an acute angle to the arcuately formed caulking gun support member 227, thereby producing an extension ladder rail receiving recess X. Finger 110 and the step ladder step resting member 111 integrally form a flange that is joined at right angles at bend 114 with web 115. Web 115 is acutely joined at bend 116 with the other side of the arcuately formed caulking gun support member 227, thereby producing the step ladder rail receiving recess Y. KK in FIG. 10 is made from sheet metal blank K, as shown in FIG. 3.

FIG. 11 is a top or bottom plan view of the caulking gun holder for an extension ladder and for a step ladder as made from FIG. 6 as it would be seen from above when mounted upon a ladder or when seen from below and showing parallel flanges. Reversible finger 10, extension ladder step resting member 11 and the extension ladder connecting member 13 integerally form a flange that is connected at right angles at bend 14 to connecting web 15. Connecting web 15 is joined at right angles at bend 16 to flange 18. Flange 18 joins the arcuately formed caulking gun support member 222 at bend 19. At the other side of the arcuately formed caulking gun support member 222 is joined flange 118 at bend 119. Flange 118 is joined at a right angle to the step ladder connecting web 115 at bend 116. The step ladder connecting web 115 joins the integrally formed flange, made from the step ladder step resting member 11 and reversible finger 110, at a right angle at bend 114, producing the step ladder rail receiving recess V. U is the extension ladder rail receiving recess formed by the parallel flange 18 and the integrally formed flange, made from members 111 and 110. NN in FIG. 11 is amde from sheet metal blank N, as shown in FIG. 6.

FIG. 12 is another modification of FIG. 11 of a Caulking Gun Holder for an extension ladder or for a step ladder as made from FIG. 6 as it would be seen from above when mounted upon a ladder or when seen from below and showing parallel flanges. FIG. 12 differs from FIG. 11 in that in FIG. 11, bend 14 is adjacent to bend 116, whereas in FIG. 12 bend 16 is adjacent to bend 114. But for this one difference, the discriptions of FIG. 11 and FIG. 12 are identical.

FIG. 13 is still another modification of FIG. 11 of a Caulking Gun Holder for an extension ladder or for a step ladder as made fom FIG. 6 as it would be seen from above when mounted upon a ladder or when seen from below and again showing parallel flanges. In FIG. 13 bend 16 is adjacent to bend 116. The rest of the description is the same as in FIGS. 11 and 12.

FIG. 14 is a top or bottom plan view of the Caulking Gun Holder for an extension ladder as made from FIG. 4 and which shows parallel flanges. Reversible finger 10, extension ladder step resting member 11, and connecting member 13 integrally form a first flange, which is joined at a right angle at bend 14 with connecting web 15. Connecting web 15 joins at a right angle at bend 16 with the parallel second flange 18. The parallel second flange 18 joins the arcuately formed caulking gun support member 22 at bend 19. The parallel second flange 18 and the integrally formed first flange, made from members 10, 11 and 13 produce the extension ladder rail receiving recess U.

FIG. 15 is a perspective view of a step ladder with a Caulking Gun Holder for a step ladder mounted upon the left rail and a Caulking Gun Holder for a step ladder mounted upon the right rail and both made from FIG. 2 and both showing an arcuately formed flange. Reversible finger 110 and the step ladder step resting member 111 integrally form a flange that is joined at a right angle at bend 114 to connecting web 115. Connecting web 115 is joined at an acute angle at bend 116 with the arcuately formed caulking gun support member 127. The finger 110 is seen locked behind the step G. The step ladder step resting member 111 is seen resting upon the top face GT of the step ladder's step G. The step ladder rail receiving recess Y (as seen in FIG. 8) surrounds the step ladder's rail F, with member 111 adjacent to the inside edge FI of the step ladder's rail F. The connecting web 115 is adjacent to the forward edge FF and FF' of the rail F and F'. The arcuately formed flange and caulking gun support member 127 is seen adjacent to the outer edge FO of the rail F and F'. To place the Caulking Gun Holder upon a step ladder, one meerly slips the rail receiving recess Y upon the rail F or F', pushs the Caulking Gun Holder backwards onto the rail F or F', and then slides the Caulking Gun Holder downwards until the step resting member 111 mates with the top face GT of the step G.

FIG. 16 is a perspective view of a step ladder with a caulking gun holder for an extension ladder and for a step ladder as made from FIG. 3 mounted upon the left and right rails, and both showing arcuately formed flanges. To mount the Caulking Gun Holder KK of FIG. 10 onto a step ladder, one pushs the step ladder's rail receiving recess Y onto the rail F or F' of the Step ladder S until web 115 mates with the foward edge FF or FF' of the rail F or F'. Then one slides the Caulking Gun Holder vertically downward until the step ladder step resting member 111 rests up the top face GT of step G. The detailed description of KKK and KKK' have been given as KK in FIG. 10.

FIG. 17 is a perspective view of a Caulking Gun Holder for an extension ladder as made from FIG. 4 showing parallel flanges. The detailed description of LLL in FIG. 17 has been given in FIG. 14 as LL. The parallel flange 18 and the integrally formed flange, made from members 10, 11, and 13 can be readly seen in FIG. 17.

FIG. 18 is a perspective view of a Caulking Gun Holder for an extension ladder and for a step ladder as made from FIG. 3 showing an arcuately formed flange for both the extension ladder attachment means X, and for the step ladder attachment means Y. The detailed description for KKKK in FIG. 18 has been given as KK in FIG. 10. KKKK in FIG. 18 shows the arcuately formed flanges and caulking gun support member 227 in perspective.

FIG. 19 is a perspective view of a Caulking Gun Holder for a step ladder as made from FIG. 5 showing parallel flanges. Reversible finger 110 and the step ladder step resting member 111 integrally form a flange that is joined at a right angle at bend 115 with connecting web 115. Connecting web 115 is joined at a right angle at bend 116 with the parallel flange 118. The arcuately formed caulking gun support member 122 is joined to the parallel flange 118 at bend 119, to produce a Caulking Gun Holder containing a step ladder rail receiving recess V formed from members 111, 115 and 118. MM in FIG. 19 is made from M, as shown in FIG. 5.

FIG. 20 is a top or bottom plan view of still another modification the Caulking Gun Holder for a step ladder of FIG. 19 as made from FIG. 5 showing parallel flanges and an oblong arcuately formed caulking gun receiving means 122. The arcuately formed caulking gun support member 122 does not have to be circular. The configuration of the caulking gun support member 122 as shown in FIG. 20 is oblong. The only requirement is that the caulking gun C (shown in FIG. 9) fit within the arcuately formed caulking gun support member 122. This can be accomplished by anyone skilled in the art using common sense.

We claim:

1. A Caulking Gun Holder for either the left-hand rail or the right-hand rail of a step ladder of the character described comprising a single length of a stout but bendable metal sheet having an integrally formed first flange, substantially in the shape of a Bold T with a broadened base, to provide a first step receiving recess formed from the left half of said Bold T and to provide a second step receiving recess formed from the right half of said Bold T; along the length of said broadened base of said Bold T, said Bold T is connected at a right angle to a web member that lies over the foward edge of either of said rails of said step ladder; said web member is connected at an acute angle to an arcuately formed caulking gun support second flange; and a rail receiving recess, substantially in the shape of the letter U with one of the arms of said letter U arcuately concaved inwards toward the other arm, is provided by the cooperation of said web member with said first flange and with said arcuately formed caulking gun support second flange.

2. A Caulking Gun Holder for either the left-hand rail or the right-hand rail of a step ladder of the character described comprising a single length of a stout but bendable metal sheet having an integrally formed first flange, substantially in the shape of a Bold T with a broadened base, to provide a first step receiving recess formed from the left half of said Bold T and to provide a second step receiving recess formed from the right half of said Bold T; along the length of said broadened base of said Bold T, said Bold T is connected at a right angle to a web member that lies over the foward edge of either of said rails of said step ladder; said web member is connected at a right angle to a parallel second flange; said parallel second flange is connected to an arcuately formed caulking gun support member; and a rail receiving recess, substantially in the shape of the letter U, is provided by the cooperation of said web member with said first flange and with said parallel second flange.

3. A Caulking Gun Holder for either the left-hand rail or the right-hand rail of an extension ladder of the character described comprising a single length of a stout but bendable metal sheet having an integrally formed first flange, substantially in the shape of the Bold letter H with one leg widened, to provide a first step receiving recess formed from the top half of said letter H and to provide a second step receiving recess formed from the bottom of said letter H; along the length of said widened leg of said Bold letter H, said Bold letter H is connected at a right angle to a web member that lies over the forward edge of either of said rails of said extension ladder; said web member is connected at an acute angle to an arcuately formed caulking gun support second flange; a rail receiving recess, substantially in the shape of a letter U with one of the arms of said letter U arcuately concaved inwards toward the other arm, is provided by the cooperation of said web member with said first flange and with said arcuately formed caulking gun support second flange.

4. A Caulking Gun Holder for either the left-hand rail or the right-hand rail of an extension ladder of the character described comprising a single length of a stout but bendable metal sheet having an integrally formed first flange, substantially in the shape of the Bold letter H with one leg widened, to provide a first step receiving recess formed from the top half of said letter H and to provide a second step receiving recess formed from the bottom of said letter H; along the length of said widened leg of said Bold letter H, said Bold letter H is connected at a right angle to a web member that lies over the forward edge of either of said rails of said extension ladder; said web member is connected at a right angle to a parallel second flange; said parallel second flange is connected to an arcuately formed caulking gun support member; a rail receiving recess, substantially in the shape of a letter U is provided by the cooperation of said web member with said first flange and with said parallel second flange.

5. A Caulking Gun Holder for either the left-hand rail or the right-hand rail of a step ladder or for either the left-hand rail or the right-hand rail of an extension ladder of the character described comprising a single length of a stout but bendable metal sheet having an integrally formed first flange, substantially in the shape of a Bold letter T with a broadened base, to provide a first step receiving recess formed from the left half of said Bold letter T and a second step receiving recess formed from the right half of said Bold letter T; along the length of said widened base of said Bold letter T, said Bold letter T is connected at a right angle to a first web member; said first web member is connected at a right angle to a parallel second flange; said parallel second flange is connected to an arcuately formed caulking gun support member; said arcuately formed caulking gun support member is connected to a parallel third flange; said parallel third flange is connected at a right angle to a second web member; said second web member is connected at a right angle to an integrally formed forth flange, substantially in the shape of the Bold letter H with one leg widened, to provide a third step receiving recess formed from the top half of said letter H and forth step receiving recess formed from the bottom of said letter H; a first rail receiving recess, substantially in the shape of a letter U is provided by the cooperation of said first web member with said first flange and with said parallel second flange; a second rail receiving recess, substantially in the shape of a letter U is provided by the cooperation of said second web member with said parallel third flange and with said forth flange.

6. A Caulking Gun Holder for either the left-hand rail or the right-hand rail of a step ladder or for either the left-hand rail or the right-hand rail of an extension ladder of the character described comprising a single length of a st out but bendable metal sheet having an integrally formed first flange, substantially in the shape of a Bold letter T with a broadened base, to provide a first step receiving recess formed from the left half of said Bold letter T and a second step receiving recess formed from the right half of said Bold letter T; along the length of said widened base of said Bold letter T, said Bold letter T is connected at a right angle to a first web member; said first web member is connected to an arcuately formed caulking gun support member; said arcuately formed caulking gun support member is connected to a second web member; said second web member is connected at a right angle to an integrally formed second flange, substantially in the shape of the Bold letter H with one leg widened, to provide a third step receiving recess formed from the top half of said letter H and a forth step receiving recess formed from the bottom of said letter H; a first rail receiving recess, substantially in the shape of a letter U with one of the arms of said letter U arcuately concaved inwards toward the other arm, is provided by the cooperation of said first web member with said first flange and with said arcuately formed caulking gun support member; a second rail receiving recess, substantially in the shape of a letter U with one of the arms of said letter U arcuately concaved inwards toward the other arm, is provided by the cooperation of said second web member with said arcuately formed caulking gun support member and with said integrally formed second flange.

* * * * *